US006094839A

United States Patent [19]

Nikolov

[11] Patent Number: 6,094,839

[45] Date of Patent: Aug. 1, 2000

[54] FOOTWEAR DRYING APPARATUS

[76] Inventor: Dimitar Nikolov Nikolov, 685 McCowan Rd., Scarborough, On., Canada, M1J 1J0

[21] Appl. No.: 09/309,887

[22] Filed: May 11, 1999

[51] Int. Cl.[7] ..... F26B 25/06

[52] U.S. Cl. ..... 34/225; 34/227; 34/233

[58] Field of Search ..... 34/60, 61, 90, 34/202, 223, 225, 227, 229, 233; 4/524, 525, 605

[56] References Cited

U.S. PATENT DOCUMENTS

| | | | |
|---|---|---|---|
| 1,667,315 | 4/1928 | Harris | 34/225 |
| 2,111,148 | 3/1938 | Judelson | 34/225 X |
| 5,152,077 | 10/1992 | Liang | 34/225 X |
| 5,369,892 | 12/1994 | Dhaemers | 34/224 X |
| 5,546,678 | 8/1996 | Dhaemers | 34/224 X |
| 5,600,896 | 2/1997 | Lin | 34/60 |
| 5,775,040 | 7/1998 | Ou | 34/225 X |
| 5,797,197 | 8/1998 | Alday | 34/60 X |

*Primary Examiner*—Stephen Gravini

[57] ABSTRACT

A footwear drying apparatus, comprises a housing having vertical front, rear and side walls, a top section, a drying section, and a base section. A fan is mounted within the top section, so that to blow air to the drying section. A heater is mounted adjacent to the fan, so that to heat air. A thermostat is mounted adjacent to the heater. At the top of the apparatus is mounted a control console having a timer, a fan switch, a heater switch and a thermostat knob. Air inlets are formed in the top section. An air outlet is mounted within the base section. A mud screen is fixed at the entrance of the air outlet, so that to prevent from mud entering into the air outlet. An air filter is mounted at the exit of the air outlet. A door is secured to the front wall, so that to provide access to the drying section. A mud collector is removably mounted at the bottom of the drying section, so that to collect mud from unclean footwear. A drying shelf is removably mounted above the mud collector, so that footwear can be placed on it. The apparatus is equipped with holding devices for holding high footwear made of soft material upright and opened.

15 Claims, 2 Drawing Sheets

FOOTWEAR DRYING APPARATUS

BACKGROUND OF THE INVENTION

The present invention relates to a footwear drying apparatus. Various types of footwear drying apparatuses are known. They have the following inconveniences-either do not have a compact housing or footwear must be cleaned from mud before their placing in the housing of an apparatus. People get their footwear damp in rain, in snow and while playing sports. Soldiers in the army have damp footwear almost every day. Usually civilians and soldiers need the same footwear dry as soon as possible. Therefore it is desirable to have a compact drying apparatus for unclean footwear.

BRIEF SUMMARY OF THE INVENTION

The present invention consists of a footwear drying apparatus, comprising:

a housing having generally vertical front, rear and side walls, a top section with a generally horizontal top and a generally horizontal grille at the bottom, a base section with a generally horizontal bottom and a generally horizontal partition at the top, and a drying section defined between the generally vertical front, rear and side walls, the generally horizontal grille at the bottom of the top section, and the generally horizontal partition at the top of the base section; at least one fan mounted within the top section of the housing and designed for blowing air to the drying section of the housing; at least one heater mounted within the top section of the housing adjacent to the at least one fan and designed for heating air which is sucked into the housing and blown to the drying section of the housing by the at least one fan; at least one air inlet formed in the top section of the housing, so that air can be sucked into the housing through the at least one air inlet by the at least one fan and can be heated by the at least one heater; a thermostat mounted within the top section of the housing adjacent to the at least one heater and designed for maintaining the desired drying temperature at a constant level; a control console having a timer for controling the drying duration, at least one fan switch for turning the at least one fan on and off and for selecting its speed, at least one heater switch for turning the at least one heater on and off and for selecting its power, a thermostat knob for setting the thermostat at the desired drying temperature, and a terminal block for connecting a power cord to wiring of the apparatus; at least one air outlet mounted within the base section of the housing, so that air can be exhausted from the housing through the at least one air outlet by the at least one fan; at least one air filter mounted within the at least one air outlet, so that to filter the exhausted air; a door secured to the generally vertical front wall of the housing, so that to provide access to the drying section of the housing; at least one mud collector fixed at the bottom of the drying section of the housing, so that to collect mud from unclean footwear; at least one drying shelf fixed within the drying section of the housing above the at least one mud collector, so that footwear can be placed on the at least one drying shelf; at least one holding device for holding high footwear made of soft material upright and opened; and a plurality of rings mounted at the bottom of the generally horizontal grille of the top section of the housing. The control console is mounted at the top of the apparatus. The at least one air filter may be mounted at the exit of the at least one air outlet. The at least one air filter may be mounted at the entrance of the at least one air outlet. The at least one mud collector may be removably mounted and can be taken out to be cleaned. The at least one drying shelf may be removably mounted and can be taken out to be cleaned. Each of the at least one holding device for holding high footwear made of soft material upright and opened may have a hook at its upper end for attaching to one of the plurality of rings, a clip at its lower end for attaching to the footwear, a string for connecting the hook to the clip, and a device for regulating the length of the string. Each of the at least one holding device for holding high footwear made of soft material upright and opened may have a hook at its upper end for attaching to one of the plurality of rings, a clip at its lower end for attaching to the footwear, and an elastic string for connecting the hook to the clip. At least one mud screen is fixed at the entrance of the at least one air outlet, so that to prevent from mud entering into the at least one air outlet. The at least one mud screen may be removably mounted and can be taken out to be cleaned. A door switch is mounted adjacent to the door. The door switch is designed for shutting off the apparatus when the door is opened. At least one bulb is mounted within the drying section of the housing, so that to light the drying section when the door is opened. At least one handle is mounted outside of the housing, so that the apparatus can be lifted and relocated. A plurality of leveling legs are mounted at the generally horizontal bottom of the base section of the housing for leveling the apparatus.

DETAILED DESCRIPTION OF THE INVENTION

Figure 1:
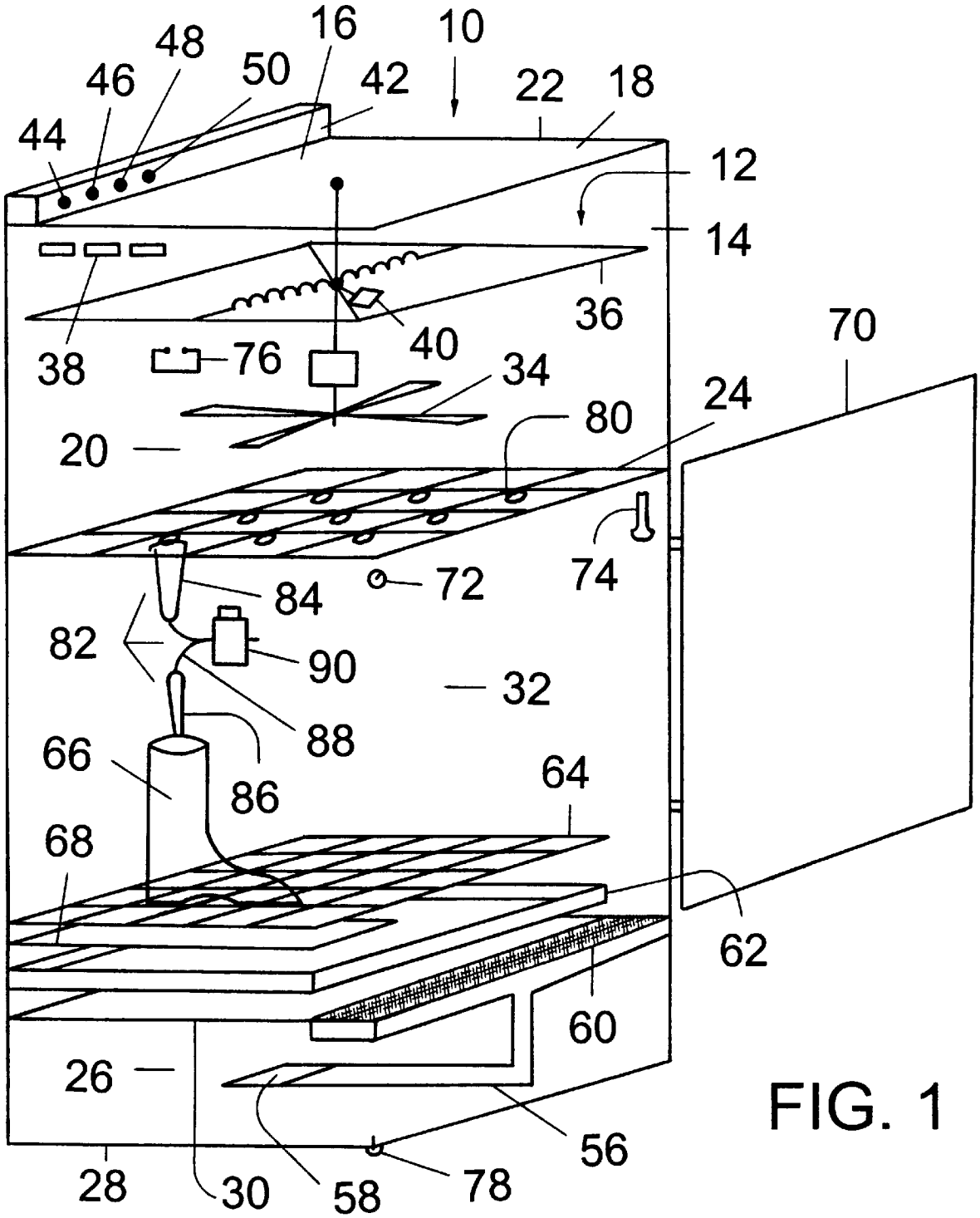
FIG. 1 is a schematic view illustrating the use of the footwear drying apparatus according to this invention.
Figure 2:
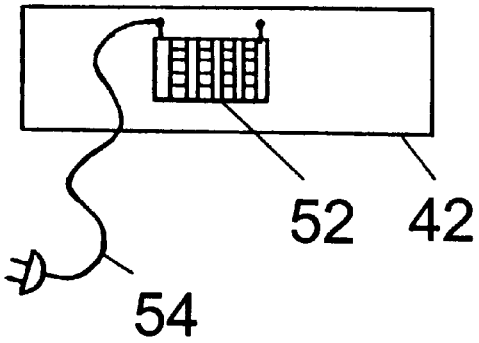
FIG. 2 is a rear view of the control console showing the terminal block and the power cord of the apparatus according to this invention.
Figure 3:
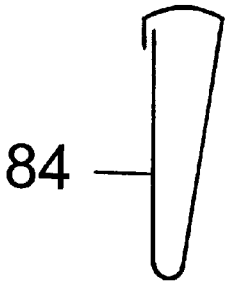
FIG. 3 is a side view of the hook of the holding device for holding high footwear made of soft material upright and opened.
Figure 4:
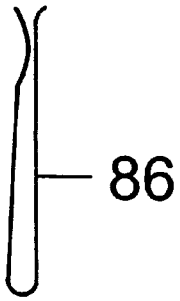
FIG. 4 is a side view of the clip of the holding device for holding high footwear made of soft material upright and opened.
Figure 5:
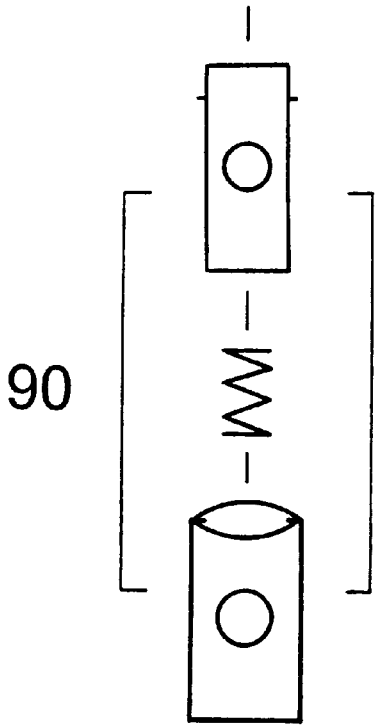
FIG. 5 is an exploded view of the device for regulating the length of the string of the holding device for holding high footwear made of soft material upright and opened.

Referring to FIGS. 1–5, a footwear drying apparatus 10 comprises a housing 12. The housing 12 has generally vertical front wall 14, rear wall 16 and side walls 18, a top section 20 with a generally horizontal top 22 and a generally horizontal grille 24 at the bottom, a base section 26 with a generally horizontal bottom 28 and a generally horizontal partition 30 at the top, and a drying section 32 defined between the generally vertical front wall 14, rear wall 16 and side walls 18, the generally horizontal grille 24 at the bottom of the top section 20 and the generally horizontal partition 30 at the top of the base section 26. A fan 34 is mounted within the top section 20 of the housing 12. The fan 34 is designed for blowing air to the drying section 32 of the housing 12. A heater 36 is mounted within the top section 20 of the housing 12 adjacent to the fan 34. The heater 36 is designed for heating air which is sucked into the housing 12 and blown to the drying section 32 of the housing 12 by the fan 34. Air inlets 38 are formed in the top section 20 of the housing 12, so that air can be sucked into the housing 12 through the air inlets 38 by the fan 34 and can be heated by the heater 36. A thermostat 40 is mounted within the top section 20 of the housing 12 adjacent to the heater 36. The thermostat 40 is designed for maintaining the desired drying temperature at a constant level. A control console 42 is mounted at the top of the apparatus 10. The control console 42 has a timer 44 for controling the drying duration, a fan switch 46 for turning the fan 34 on and off and for selecting its speed, a heater switch 48 for turning the heater 36 on and off and for selecting its power, a thermostat knob 50 for setting the thermostat 40 at the desired drying temperature, and a terminal block 52 for connecting a power cord 54 to wiring of the apparatus 10. An air outlet 56 is mounted within the base section 26 of the housing 12, so that air can be exhausted from the housing 12 through the air outlet 56 by the fan 34. An air filter 58 is mounted at the exit of the air outlet 56, so that to filter the exhausted air. A mud screen 60 is fixed at the entrance of the air outlet 56, so that to prevent from mud entering into the air outlet 56. A mud collector 62 is removably mounted at the bottom of the drying section 32 of the housing 12, so that to collect mud from unclean footwear. A drying shelf 64 is removably mounted within the drying section 32 of the housing 12 above the mud collector 62, so that footwear 66 can be placed on the drying shelf 64. The mud collector 62 and the drying shelf 64 are removably mounted between ledges 68 (only one is shown), and can be taken out to be cleaned. A door 70 is secured to the generally vertical front wall 14 of the housing 12, so that to provide access to the drying section 32 of the housing 12. A door switch 72 is mounted adjacent to the door 70. The door switch 72 is designed for shutting off the apparatus 10 when the door 70 is opened. A bulb 74 is mounted within the drying section 32 of the housing 12, so that to light the drying section 32 when the door 70 is opened. A pair of handles 76 (only one is shown) are mounted outside of the housing 12, so that the apparatus 10 can be lifted and relocated. A plurality of leveling legs 78 (only one is shown) are mounted at the generally horizontal bottom 28 of the base section 26 of the housing 12 for leveling the apparatus 10. A plurality of rings 80 are mounted at the bottom of the generally horizontal grille 24 of the top section 20 of the housing 12. The apparatus 10 is equipped with holding devices 82 (only one is shown) for holding high footwear made of soft material upright and opened. Each holding device 82 has a hook 84 at its upper end for attaching to one of the plurality of rings 80, a clip 86 at its lower end for attaching to the footwear 66, a string 88 for connecting the hook 84 to the clip 86 and a device 90 for regulating the length of the string 88.

Although only a single embodiment of the present invention has been described and illustrated, the present invention is not limited to the features of this embodiment.

I claim:

1. A footwear drying apparatus, comprising:

a housing having generally vertical front, rear and side walls, a top section with a generally horizontal top and a generally horizontal grille at the bottom, a base section with a generally horizontal bottom and a generally horizontal partition at the top, and a drying section defined between the generally vertical front, rear and side walls, the generally horizontal grille at the bottom of the top section, and the generally horizontal partition at the top of the base section;

at least one fan mounted within the top section of the housing and designed for blowing air to the drying section of the housing;

at least one heater mounted within the top section of the housing adjacent to the at least one fan and designed for heating air which is sucked into the housing and blown to the drying section of the housing by the at least one fan;

at least one air inlet formed in the top section of the housing, so that air can be sucked into the housing through the at least one air inlet by the at least one fan and can be heated by the at least one heater;

a thermostat mounted within the top section of the housing adjacent to the at least one heater and designed for maintaining the desired drying temperature at a constant level;

a control console having a timer for controling the drying duration, at least one fan switch for turning the at least one fan on and off and for selecting its speed, at least one heater switch for turning the at least one heater on and off and for selecting its power, a thermostat knob for setting the thermostat at the desired drying temperature, and a terminal block for connecting a power cord to wiring of the apparatus;

at least one air outlet mounted within the base section of the housing so that air can be exhausted from the housing through the at least one air outlet by the at least one fan;

at least one air filter mounted within the at least one air outlet, so that to filter the exhausted air;

a door secured to the generally vertical front wall of the housing, so that to provide access to the drying section of the housing;

at least one mud collector fixed at the bottom of the drying section of the housing, so that to collect mud from unclean footwear;

at least one drying shelf fixed within the drying section of the housing above the at least one mud collector, so that footwear can be placed on the at least one drying shelf;

at least one holding device for holding high footwear made of soft material upright and opened; and a plurality of rings mounted at the bottom of the generally horizontal grille of the top section of the housing.

2. An apparatus as claimed in claim 1, wherein the control console is mounted at the top of the apparatus.

3. An apparatus as claimed in claim 1, wherein the at least one air filter is mounted at the exit of the at least one air outlet.

4. An apparatus as claimed in claim 1, wherein the at least one air filter is mounted at the entrance of the at least one air outlet.

5. An apparatus as claimed in claim 1, wherein the at least one mud collector is removably mounted and can be taken out to be cleaned.

6. An apparatus as claimed in claim 1, wherein the at least one drying shelf is removably mounted and can be taken out to be cleaned.

7. An apparatus as claimed in claim 1, wherein each of the at least one holding device for holding high footwear made of soft material upright and opened having a hook at its upper end for attaching to one of the plurality of rings, a clip at its lower end for attaching to the footwear, a string for connecting the hook to the clip, and a device for regulating the length of the string.

8. An apparatus as claimed in claim 1, wherein each of the at least one holding device for holding high footwear made of soft material upright and opened having a hook at its upper end for attaching to one of the plurality of rings, a clip at its lower end for attaching to the footwear, and an elastic string for connecting the hook to the clip.

9. An apparatus as claimed in claim 1, wherein the apparatus further comprising at least one mud screen fixed at the entrance of the at least one air outlet, so that to prevent from mud entering into the at least one air outlet.

10. An apparatus as claimed in claim 9, wherein the at least one mud screen is removably mounted and can be taken out to be cleaned.

11. An apparatus as claimed in claim 1, wherein the apparatus further comprising a door switch designed for shutting off the apparatus when the door is opened.

12. An apparatus as claimed in claim 11, wherein the door switch is mounted adjacent to the door.

13. An apparatus as claimed in claim 1, wherein the apparatus further comprising at least one bulb mounted within the drying section of the housing, so that to light the drying section when the door is opened.

14. An apparatus as claimed in claim 1, wherein the apparatus further comprising at least one handle mounted outside of the housing, so that the apparatus can be lifted and relocated.

15. An apparatus as claimed in claim 1, wherein the apparatus further comprising a plurality of leveling legs mounted at the generally horizontal bottom of the base section of the housing for leveling the apparatus.

* * * * *